US005461948A

United States Patent [19]

Perrero, Jr.

[11] Patent Number: 5,461,948

[45] Date of Patent: Oct. 31, 1995

[54] SOCKET TYPE TOOL FOR REMOVING OIL FILTER CARTRIDGE

[76] Inventor: Thomas Perrero, Jr., 6375 Glenoaks St., Murray, Utah 84107

[21] Appl. No.: 132,573

[22] Filed: Oct. 6, 1993

Related U.S. Application Data

[63] Continuation of Ser. No. 935,902, Aug. 27, 1992, abandoned.

[51] Int. Cl.[6] ..... B25B 13/18

[52] U.S. Cl. ..... 81/128; 81/186

[58] Field of Search ..... 81/126–128, 179, 81/186, 185.1, 419–423, 426.5; 269/268, 271, 272, 280, 282

[56] References Cited

U.S. PATENT DOCUMENTS

| | | | |
|---|---|---|---|
| 2,612,735 | 10/1952 | Lea | 269/282 X |
| 3,208,669 | 10/1966 | Weaver | 81/186 X |
| 3,910,140 | 10/1975 | Rose | 81/176.3 |
| 4,532,835 | 8/1985 | Schwitters | 81/128 |
| 4,663,999 | 5/1987 | Colvin | 81/128 |
| 4,778,730 | 10/1988 | Zucker | 81/900 X |
| 5,092,074 | 3/1992 | Zincke | 81/418 X |
| 5,148,726 | 9/1992 | Huebschen et al. | 81/186 X |

*Primary Examiner*—D. S. Meislin
*Attorney, Agent, or Firm*—Terry M. Crellin

[57] ABSTRACT

A tool for removing oil filter canisters or cartridges from an internal combustion engine, consists of a pair of elongate sidewalls that extend from the base of the tool along substantially the entire length of a canister or cartridge that is to be removed. The sidewalls of the tool are arranged to be drawn together by a cam and slot mechanism which is incorporated in the base of the tool and which is operated by an axially applied wrench. The sidewalls of the tool slant toward each other such that the distal ends of the sidewalls make primary, initial, gripping contact with the base of the canister or cartridge, with the inner surface of the sidewalls making secondary, gripping contact with a substantial portion of the sidewall of the canister or cartridge.

8 Claims, 4 Drawing Sheets

SOCKET TYPE TOOL FOR REMOVING OIL FILTER CARTRIDGE

This application is a division of application Ser. No. 07/935,902, filed Aug. 27, 1992, now abandoned.

BACKGROUND OF THE INVENTION

1. Field of the Invention

The present invention relates to improvements in a socket type tool used in removing oil filter cartridges in limited access locations on internal combustion engines.

2. State of the Art

There are many versions of oil filter tools currently available. In one such device a strap is provided for encircling the filter cartridge, and a handle associated with the strap tightens the strap around the filter cartridge. The strap form of tool is relatively inexpensive and in theory is supposed to spread the gripping force about the complete periphery of the cartridge. All too often, however, the force necessary to turn the oil filter canister results in crushing of the typical thin sheet metal side walls of the filter cartridge. In most cases, the strap tool twists and crushes the canister before the canister turns, and the workman is then presented with a formidable task of removing the crushed, twisted canister from its mounting to the engine.

Other forms of tools have been devised to accommodate removal of an oil filter canister from its mounting to an internal combustion engine. Three similar type tools are described in U.S. Pat. Nos. 3,119,290; 3,910,140; and 4,532,835 wherein a socket-like tool is provided for accessing the oil filter cartridge axially. These tools bear a resemblance to a socket wrench that fits over the distal end of the oil filter cartridge. These tools have arcuate, encircling jaws that grasp the distal end of the oil filter cartridge, with torque being applied to the periphery of the distal end of the oil filter cartridge. Generally, in the socket form of tool described in the referenced patents, the socket portion is formed in two halves which may be drawn together by a cam and slot arrangement to engage and grip the periphery of the oil filter cartridge and provide removal torque. Unfortunately, the socket type of tool of the prior art has the same tendency as the strap tool mentioned previously to twist and crush the oil filter cartridge. Once the oil filter cartridge has been twisted and crushed, it is a very laborious, time consuming job to remove the twisted, crushed oil filter cartridge from its engagement to the engine.

OBJECTIVES

The principal objective of the present invention is to provide an improvement on the socket type of oil filter cartridge gripping tool in which two gripping halves of the tool have sidewalls that extend substantially along the entire length of the oil filter cartridge, with the sidewalls being slanted inwardly toward the central axis of the tool such that the distal ends of the sidewalls make primary contact with the oil filter cartridge at the base of the oil filter cartridge, and then as the two halves grip together, the sidewalls make engagement along a substantial portion of the length of the oil filter cartridge. This allows the primary gripping force to be applied by the distal ends of the sidewalls of the gripping halves of the tool at the base of the oil filter cartridge where the oil filter cartridge has maximum strength and resistance to twisting and crushing. Supplemental torque is then applied along a substantial portion of the length of the oil filter cartridge by the cylindrical surfaces of the gripping halves.

Another objective of the present invention is to provide such an improvement as noted in the preceding paragraph wherein each of the sidewalls of the gripping halves comprise two telescopically adjustable parts, wherein the effective longitudinal length of the sidewalls, i.e., the length that the sidewall extend from the flat base portion of the tool, can be adjusted to accommodate oil filter canisters of different lengths.

BRIEF DESCRIPTION OF THE INVENTION

The basic tool, of which the present invention provides a useful improvement, consists of a pair of flat base members each of which has a cartridge-engaging flange or upturned end projection extending upwardly from one end thereof. The base members are arranged in overlapping sliding engagement, with each base member having a distal end that projects outwardly from the axial centerline of the tool and with the outwardly extending distal end of each base member having a cartridge-engaging flange or upturned end projecting upwardly therefrom so that the resulting pair of cartridge-engaging flanges or upturned ends may be drawn linearly toward one another as the base members slide over each other. This closes the sides of the socket formed by the cartridge-engaging flanges or upturned ends of the base members to grip and engage the filter cartridge as torque is applied to the tool at an axial location thereon. Torque is applied by means of a conventional wrench, either a socket wrench, an adjustable wrench, a box end wrench or an open end wrench, to a nut at the lower end of the tool adjacent to the outer facing face of the pair of base members. The nut is associated with a cam and slot arrangement formed in the pair of base members for moving the base members together or apart depending upon the direction of rotation of the nut.

The basic form of the tool as described in the preceding paragraph is completely conventional and well known in the prior art, and does not, therefore, form any basis on which patentability of the improvement of the present invention relies. The improvement of the present invention comprises modifying the cartridge-engaging flanges or upturned ends of the base members so that the flanges or upturned ends of the tools of the prior art have longitudinal sidewalls that extend upwardly from the flanges or upturned ends to extend substantially along the entire length of the oil filter cartridge when the tool is inserted over the distal end of the oil filter cartridge. The sidewalls slant inwardly toward the central axis of the tool so that the sidewalls make an included angle of between about 84 and 87 degrees with the flat upper surfaces of the flat base members.

When the sidewalls of the tool of the present invention are placed over an oil filter canister and the nut on the tool is turned, the sidewalls move toward each other and the distal ends of the sidewalls make firm, primary engagement with the base of the oil filter cartridge where the oil filter cartridge has maximum strength and resistance to crushing and twisting. The primary gripping force is thus applied to the base of the oil filter cartridge, and supplemental torque is applied along a substantial portion of the length of the oil filter cartridge by the inner surfaces of the sidewalls of the tool of the present invention, as the inner surfaces of the sidewalls move into secondary engagement with the oil filter cartridge.

In one preferred embodiment of the invention, the sidewalls are substantially semi-circular in shape, such that when the two opposed sidewalls approach each other they form a cylindrical surface that substantially parallels and matches the cylindrical surface of the oil filter canister. The distal ends-of the sidewalls can be provided with friction increasing means, such as a knife edge at the advancing corners of the sidewalls, or the distal edge of the sidewalls can be provided with spikes, serations or an abrasive surface all for the purpose of increasing the frictional engagement of the distal end of the sidewalls with the base of the oil filter canister.

In another preferred embodiment of the present invention, each of the sidewalls of the tool can be formed from two interengaging members that slide along each other in substantial telescoping fashion. The telescopically adjustable lengths of the sidewalls of this embodiment allow the effective longitudinal length of the sidewalls to be adjusted to accommodate oil filter canisters of differing lengths.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

Figure 1:
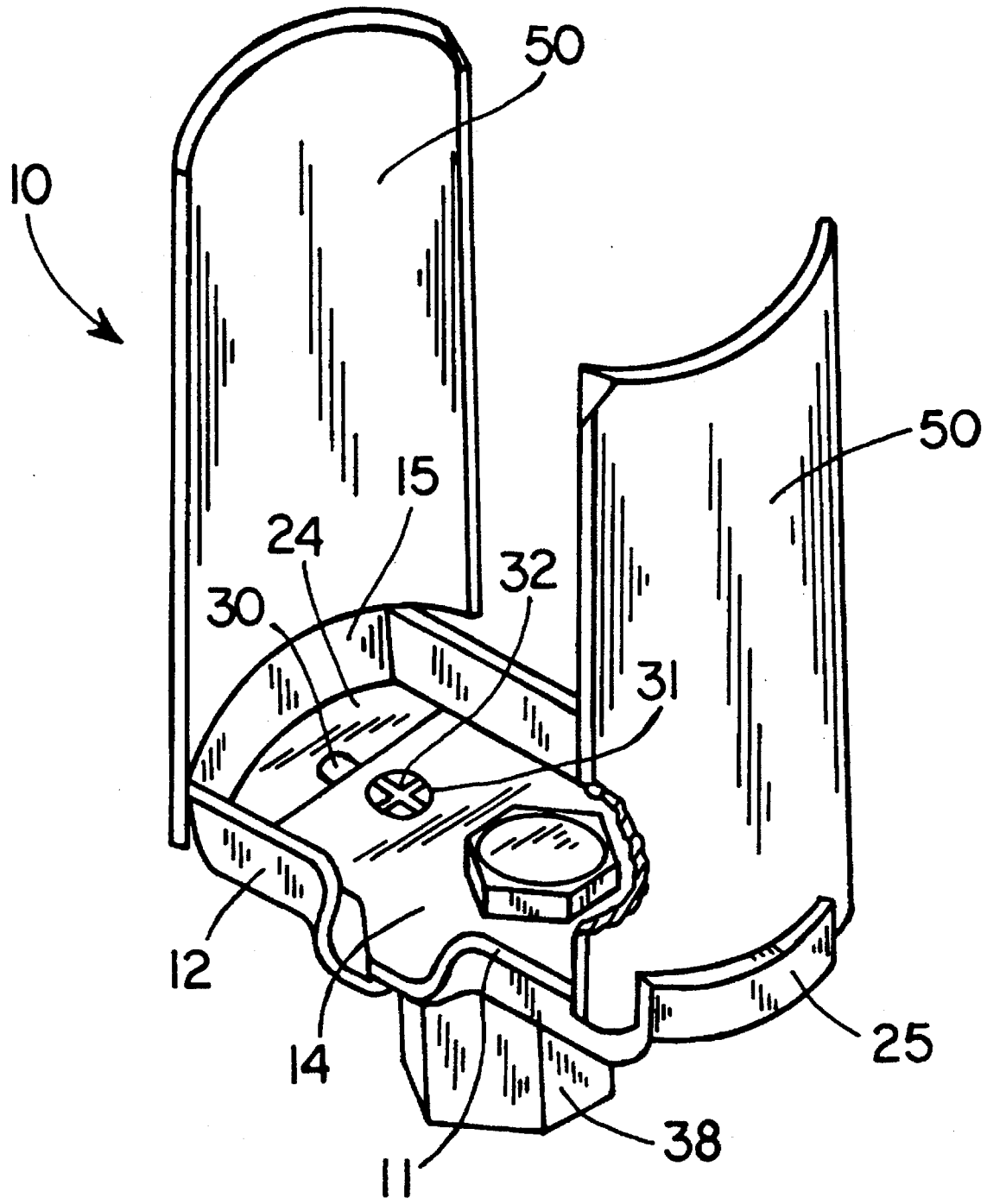
FIG. 1 is a pictorial view of an improved version of a tool in accordance with the present invention for removing an oil filter cartridge from its engagement to an internal combustion enginge.
Figure 3:
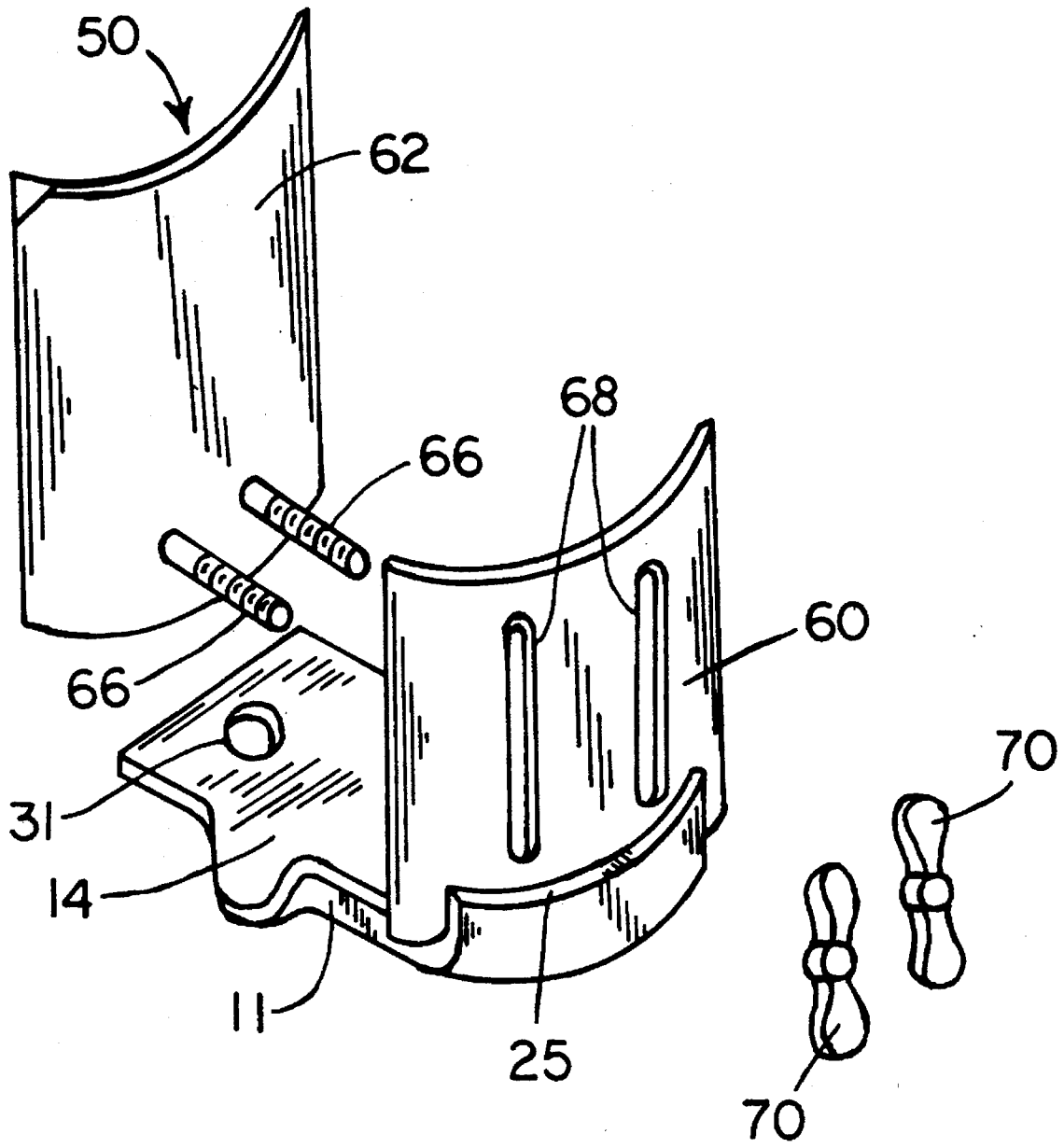
Figure 4:
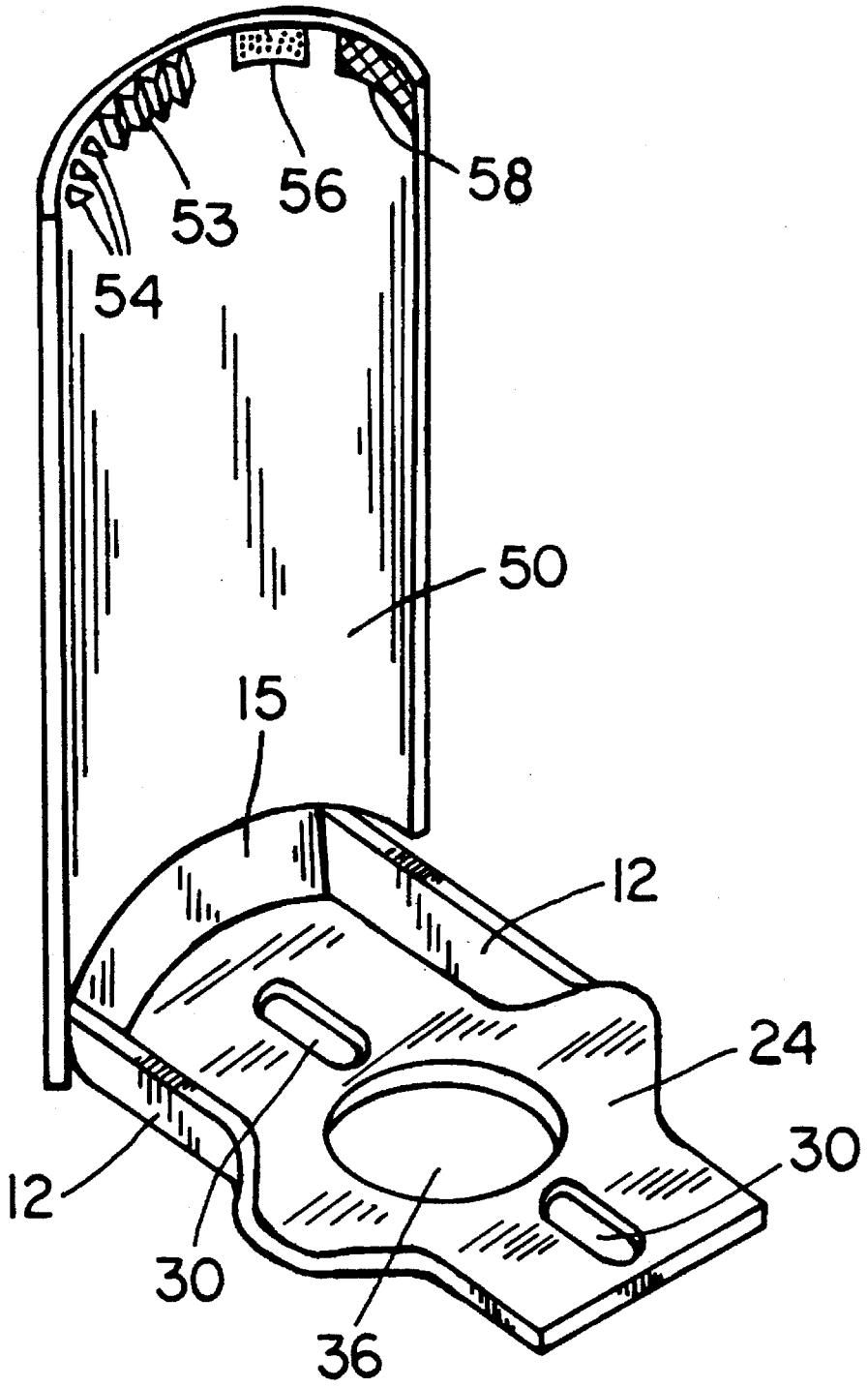

FIG. 3 is an exploded view of one base member and associated sidewall of another embodiment of the invention, wherein the sidewall comprises two sliding members that move in substantially telescopic motion; and FIG. 4 is a pictorial view of the distal end of one of the sidewalls of the tool of FIG. 1 showing different means that can be associated with the distal inner end of the sidewall of the tool for increasing the frictional engagement between the distal end of the sidewall and the base portion of an oil filter cartridge.

DETAILED DESCRIPTION OF THE ILLUSTRATED EMBODIMENTS

Referring now to the drawings, there is shown an improvement in a tool 10 for removing an oil filter cartridge from an internal combustion engine. The basic tool 10 as well known in the art consists essentially of two metal base members 11 and 12. The upper base member 11 is formed of a generally rectangular sheet of metal in a stamping operation and includes flat base portion 14 and bent upturned end 15.

The lower base member 12 is generally symmetrical with upper base member 11 and includes the similar components of base portion 24 and upturned end 25. In assembled position, the upper base member 11 is nested within lower base member 12, with upper base portion 14 adjacent lower base portion 24.

The lower base member 12 includes a spaced pair of slots 30 aligned with one another, elongated in the longer dimension of lower base portion 24, and positioned generally in the center of base portion 24. Upper base member 11 includes a corresponding pair of holes 31 in base portion 14 in registry with slots 30 and which receive fasteners such as rivets 32 for slidably securing the respective base portions 14 and 24. The upper and lower base members 11 and 12 thus are arranged for limited linear sliding movement relative to one another with rivets 32 fixed in holes 31 for movement with upper base member 11 and limiting movement by engagement with the sides and either end of slots 30. In this movement, the pairs of upturned ends 15 and 25 are moved toward or away from one another.

The upturned ends 15 and 25 are bent at approximately a ninety degree angle to respective base portions 14 and 24 and extend upwardly about one-half inch to one inch. The upturned ends 15 and 25 are moved together or apart by means of a cam and slot interconnection between the upper and lower base members 11 and 12. The upper base member 11 includes a slot 35 between holes 31 in the middle of base portion 14. The slot 35 is elongated in a transverse direction. The lower base member 12 includes circular opening 36 located centrally between slots 30 and in transverse registry with slot 35 but offset linearly. Nut 38, having a short circular peripheral portion 39 of a dimension approximately the thickness of lower base portion 24, is slidably received in circular opening 36 for rotation therein. Nut 38 includes axially extending, offset, threaded bore 40, which receives shoulder bolt 42, the latter forming the cam of the cam and slot mechanism. Bolt 42 includes hex head 44, smooth shoulder 45 and threaded end 46 and is passed through slot 35 into threaded bore 40 or nut 38. Shoulder 45 is the cam portion of bolt 42 and is sized slightly greater than the thickness of upper base portion 14 so that bolt 42 can be securely fastened to nut 38 and yet allow free sliding movement between upper and lower base members 11 and 12.

The basic tool that has been described in the preceding portion of the Detailed Description of the Illustrated Embodiments is completely conventional and well known in the art. For further description of various embodiments of the construction of such tool and the operation of such tool, reference is made to U.S. Pat. Nos. 3,119,290; 3,910,140; and 4,532,835.

In accordance with the present invention, an improvement is provided for the basic tool as described heretofore. As illustrated in the drawings, the improvement comprises providing a pair of elongate sidewalls 50 that extend upwardly from the upturned ends 15 and 25 of the respective base members 11 and 12. The elongate sidewalls 50 extend a sufficient distance from the base members 11 and 12 so that when the tool 10 is received over the distal end of an oil filter canister, the projecting, distal ends of the sidewalls 50 extend to the based of the oil filter canister.

Further, in accordance with the present invention, the sidewalls 50 are slanted inwardly toward the central axis of the tool 10. The sidewalls 50 are slanted so as to make an included angle of between about 84 and 87 degrees with the flat upper surfaces of the respective base portions 14 and 24 of the upper and lower base members 11 and 12. When the tool 10 is received over the distal end of an oil filter canister, and the nut 38 is rotated so as to draw the two sidewalls 50 toward each other, the distal ends of the sidewalls 50 make initial, primary engagement with the base of the oil filter canister. As the nut 38 is further rotated, the distal ends of the sidewalls 50 firmly grips the base of the oil filter canister and secondary engagement is made between the inner surfaces of the oil filter canister. Sufficient torque can then be applied to the oil filter canister to remove the most stubborn, over-tightened oil filter canisters in a quick operation without twisting and crushing the oil filter canister.

As illustrated, it is advantageous to form each of the sidewalls 50 so that they have a substantially circular shape along a cross section taken transverse of the longitudinal direction that the sidewalls 50 extend from the base members 11 and 12. With the inner surfaces of the sidewalls 50 having a curved shape, the sidewalls 50 when drawn toward each other form a substantially cylindrical surface that matches the cylindrical surface of the oil filter canister to make uniform contact over a large portion of the surface of the oil filter canister.

Figure 2:
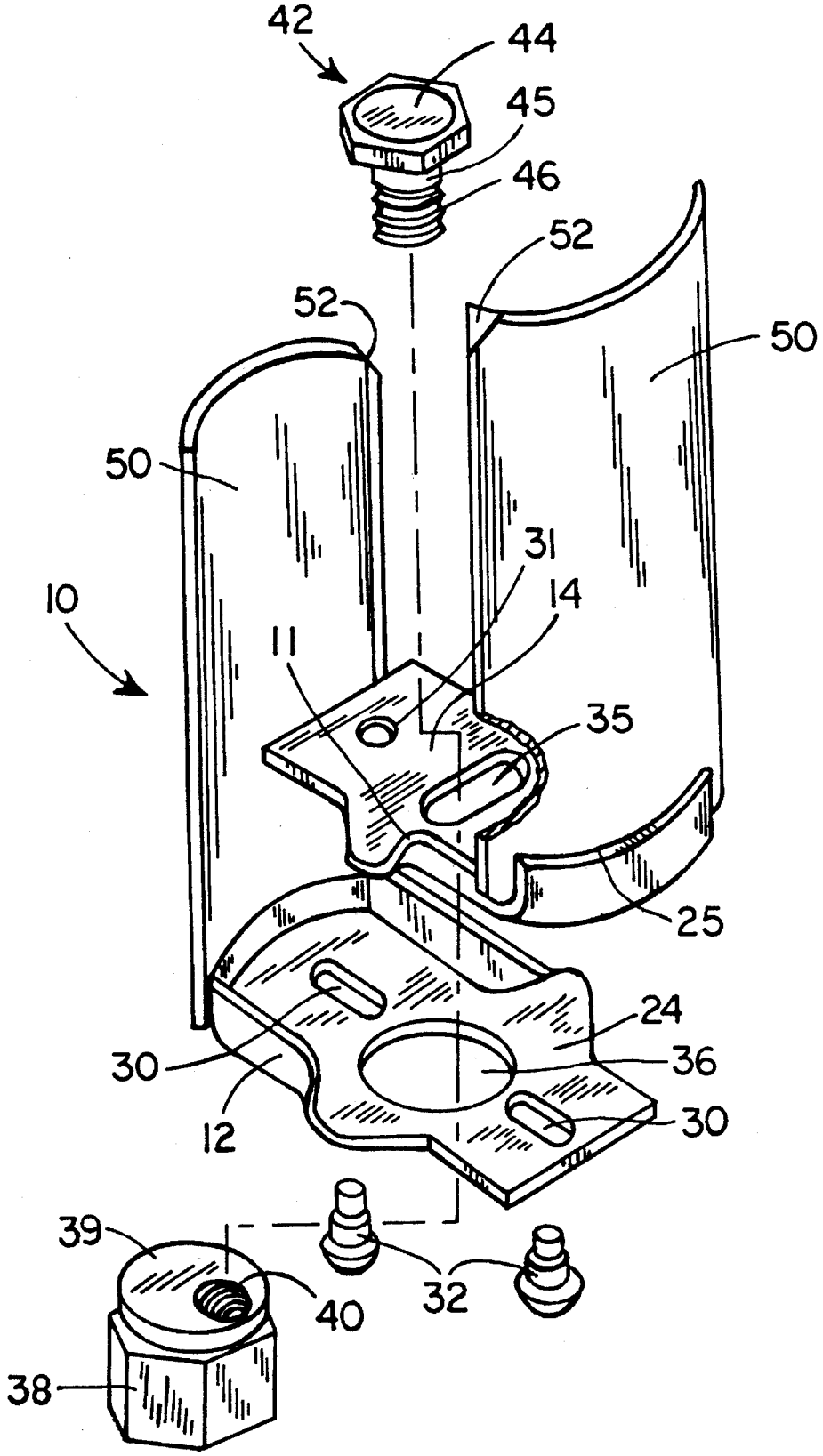
FIG. 2 is an exploded view of the tool of FIG. 1.

It is further advantageous to provide means associated with the distal end of the sidewalls 50 to increase frictional engagement between the distal end of the sidewalls 50 and the base of the oil filter canister. As shown in FIGS. 1 and 2, the advancing corners of the distal ends of the sidewalls as the tool is rotated in a counter clockwise rotation have a knife edge 52 formed therein. The pointed knife edge 52 tends to dig into the base of an oil filter canister and thereby prevents slipping of the tool on the oil filter canister. Alternate means for increasing frictional engagement are shown in FIG. 4. The alternate means comprise a serrated edge 52, internal pointed spikes 54, an abrasive liner 56 or machined knurls 58.

In FIG. 3 there is shown a modified embodiment of a sidewall 50 of the present invention. As shown, the sidewall 50 can be formed from two mated parts 60 and 62 which can slide over each other in the longitudinal direction of the tool, i.e., the direction extending perpendicular from the flat base portions 14 and 24 of the base members 11 and 12. As illustrated, the inner part 62 slides along the inner surface of the outer part 60. The inner part 62 has an internal surface that slants toward the central axis of the tool. A pair of studs 66 advantageously extend from the outer surface of the inner part 62 through corresponding elongate slots 68 in the outer part 60. Wing nuts 70 can be tightened on the studs 66 to lock the inner part 62 in any position along its telescopic, sliding movement with respect to the outer part 60. This telescopic adjustment allows the sidewall 50 to be adjusted to match the lengths of various sized oil canisters, i.e. oil filter canisters having various lengths from their distal ends to their bases.

The tool 10 can be readily made to work with oil filter canisters having varying diameters in addition to various lengths. To accommodate oil filter canisters having various diameters, the threaded bore 40 of the nut 38 is sufficiently offset from the axial centerline of the nut 38 so that the shoulder bolt 42, which acts as a cam, will move the upper base member 11 a sufficient distance relative to the lower base member 12 to accommodate a relatively large differential in diameters of oil filter canisters.

Although preferred embodiments of the improvements in a tool of the present invention have been illustrated and described, it is to be understood that the present disclosure is made by way of example and that various other embodiments are possible without departing from the subject matter coming within the scope of the following claims, which subject matter is regarded as the invention.

I claim:

1. An improvement in a tool for removing an oil filter cartridge from its mounting on an internal combustion engine, said tool being of the type having an upper base member of generally rectangular configuration and including a flat base portion having inner and outer ends;

a lower base member of generally rectangular configuration and including a flat base portion having inner and outer ends;

means for interconnecting said upper and lower base members for limited linear relative sliding movement over one another, with the outer ends of said upper and lower base members being positioned at opposite outer ends of the interconnected upper and lower base members;

a circular opening in said lower member;

a slot in said upper member, said slot being elongated in a direction transverse of the upper member and overlying said circular opening in said lower member;

a nut having a cylindrical peripheral portion rotatably disposed in said circular opening in said lower member; and a cam member eccentrically located on said nut and extending into the transverse slot in said upper base member for moving said upper base member outwardly and inwardly relative to said lower base member upon rotation of said nut, said improvement comprising a pair of elongate sidewalls, with each of said elongate sidewalls having a curved inner surface that matches the cylindrical surface of an oil filter cartridge, and further with each of said elongate sidewalls extending upwardly from an outer end of a respective upper and lower base member, wherein said elongate sidewalls have a length sufficient that when the tool is received over a distal end of an oil filter cartridge, the distal ends of the sidewalls extend to a position adjacent to a base of the oil filter cartridge; and said elongate sidewalls slant toward each other so that the internal surfaces of the sidewalls make an included angle with the flat base portions of the respective upper and lower base members of between about 84 and 87 degrees, so that when the tool is received over an oil filter cartridge and the nut is rotated to move the upper base member inwardly relative to said lower base member and thereby draw the sidewalls toward each other, the distal ends of the sidewalls make initial, primary engagement with the base of the oil filter cartridge and then the inside surfaces of the elongate sidewalls make secondary engagement with the sidewall of the oil filter cartridge.

2. An improvement in a tool for removing an oil filter cartridge from its mounting on an internal combustion engine in accordance with claim 1 wherein the distal ends of said sidewalls are provided with means for increasing the frictional engagement between the distal ends of the sidewalls and the base of the oil filter cartridge.

3. An improvement in a tool for removing an oil filter cartridge from its mounting on an internal combustion engine in accordance with claim 2 wherein said means for increasing the frictional engagement comprises knife edges formed at corners of the distal ends of said sidewalls.

4. An improvement in a tool for removing an oil filter cartridge from its mounting on an internal combustion engine in accordance with claim 2 wherein said means for increasing the frictional engagement comprises at least one inwardly directed spike adjacent to each of the distal ends of said sidewalls.

5. An improvement in a tool for removing an oil filter cartridge from its mounting on an internal combustion engine in accordance with claim 2 wherein said means for increasing the frictional engagement comprises inwardly directed serrations at each of the distal ends of said sidewalls.

6. An improvement in a tool for removing an oil filter cartridge from its mounting on an internal combustion engine in accordance with claim 2 wherein said means for increasing the frictional engagement comprises a strip of abrasive material attached to the distal ends of each of the sidewalls.

7. An improvement in a tool for removing an oil filter cartridge from its mounting on an internal combustion engine in accordance with claim 2 wherein said means for increasing the frictional engagement comprises knurling formed on the inner surfaces of each of said sidewalls adjacent to the distal ends thereof.

8. An improvement in a tool for removing an oil filter cartridge from its mounting on an internal combustion engine in accordance with claim 1 wherein each of said sidewalls is formed from inner and outer members which lie alongside each other, with the inner member being mounted to the outer member for limited linear sliding telescopic like movement along said outer member, whereby the effective length of the sidewalls can be varied by adjusting the inner members relative to the outer members.

* * * * *